US005826803A

United States Patent [19]

Cooper

[11] Patent Number: 5,826,803

[45] Date of Patent: Oct. 27, 1998

[54] LAWN AND GARDEN SPRINKLER WITH BENDABLE TUBES

[76] Inventor: Randy J. Cooper, 12273 Circula Panorama, Santa Ana, Calif. 92705

[21] Appl. No.: 854,524

[22] Filed: May 12, 1997

Related U.S. Application Data

[63] Continuation of Ser. No. 394,716, Feb. 27, 1995, abandoned.

[51] Int. Cl.[6] ..... B05B 1/14

[52] U.S. Cl. ..... 239/556

[58] Field of Search ..... 239/548, 556, 239/562, 588, 553.1, 590.3, DIG. 1, DIG. 12

[56] References Cited

U.S. PATENT DOCUMENTS

| | | | |
|---|---|---|---|
| 400,683 | 4/1889 | Jackson | 239/548 X |
| 1,484,575 | 2/1924 | Shulin | 239/588 X |
| 1,989,525 | 1/1935 | Moore | 239/588 X |
| 2,757,960 | 8/1956 | Hatcher | 239/229 |
| 2,968,443 | 1/1961 | Manning | 239/562 X |
| 3,301,490 | 1/1967 | Hruby, Jr. | 239/548 X |
| 3,402,741 | 9/1968 | Yurdin | 239/588 X |
| 5,312,047 | 5/1994 | Akers | 239/562 X |

*Primary Examiner*—Robert J. Oberleitner
*Assistant Examiner*—C. T. Bartz
*Attorney, Agent, or Firm*—Edgar W. Averill, Jr.

[57] ABSTRACT

A lawn and garden sprinkler which has a manifold with one or more bendable tubes extending therefrom. The tubes can be bent to direct one or more streams of water to a desired location. In a preferred design, there is an internal water flow restrictor which permits a larger flow of water from some tubes than others so that a maximum control of water dispersion is obtained. Also in a preferred configuration, the bendable tubes are made from a flexible material and have a ductile wire within them.

13 Claims, 3 Drawing Sheets

LAWN AND GARDEN SPRINKLER WITH BENDABLE TUBES

This is a continuation of application Ser. No. 08/394,716, filed Feb. 27, 1995, now abandoned.

BACKGROUND OF THE INVENTION

The field of the invention is lawn and garden sprinklers and the invention relates more particularly to lawn and garden sprinklers which may be adjusted to water a predetermined pattern. Various sprinklers are used for watering lawns and gardens and most are most readily adjustable to form a rectangular, circular or semi-circular shape. Often, however, the garden to be watered is an irregular shape which no predesigned pattern will fit. As a result, a great deal of water is lost watering sidewalks, streets and other areas which the user does not want to water but is forced to water by the predetermined shape of the sprinkler's spray pattern. Also, some plants might require more water than adjacent plants and most sprinklers are not equipped to provide the control necessary to create such a unique watering pattern.

A lawn sprinkler using three bendable metal tubes as shown in U.S. Pat. No. 1,989,525. This sprinkler has an internal disk from which three metal tubes extend horizontally within a circular metal pan. These tubes extend upwardly from the base of the pan and each tube has a nozzle at the end. Such sprinkler, while being attractive, would have to be very costly to fabricate. Also, the point of exit from the pan would tend to be a weak point and the durability of the device would be limited.

There is a surprisingly large variety of sprinklers which utilize flexible tubes which move in an irregular pattern as the result of the water flowing from the flexible tube. One such sprinkler is shown in U.S. Pat. No. 4,684,066. A list of flexible tube sprinklers is contained in the specification of that patent at Column 1, lines 19 and 20. Such sprinkler, however, does not permit the user to form an irregular predetermined pattern, but instead sprays water in a somewhat random manner over a more or less circular pattern with the flexible tube at its center. Note especially U.S. Pat. No. 2,757,960.

SUMMARY OF THE INVENTION

It is an object of the present invention to provide a lawn and garden sprinkler which may be adjusted to spray water in many possible patterns.

The present invention is for a lawn and garden sprinkler which has a manifold which can be attached to a hose or other source of water under pressure. At least one bendable tube is affixed at its base to the manifold and has a nozzle at its exit end. The tube or tubes may thus be bent to throw water in the direction or directions in which the user has shaped the bendable tubes so that irregular watering shapes or patterns may be more easily accommodated. Preferably, the bendable tubes have nozzle members at the end, which serve to spray water in slightly divergent paths so that the sprinkler is capable of evenly covering a large area. Also preferably, some bendable tubes throw water different distances than others in order to provide a gentle spray at close proximity as well as a more forceful spray to throw the water farther. A preferred economical and particularly easy to use construction of bendable tube uses a flexible outer tube with a ductile wire passing along its inner conduit. Also preferably, a restrictor plate has holes of different sizes and is placed under the base of the bendable tubes to economically cause different amounts of water flow to pass through different bendable tubes.

DESCRIPTION OF THE PREFERRED EMBODIMENTS

Figure 1:
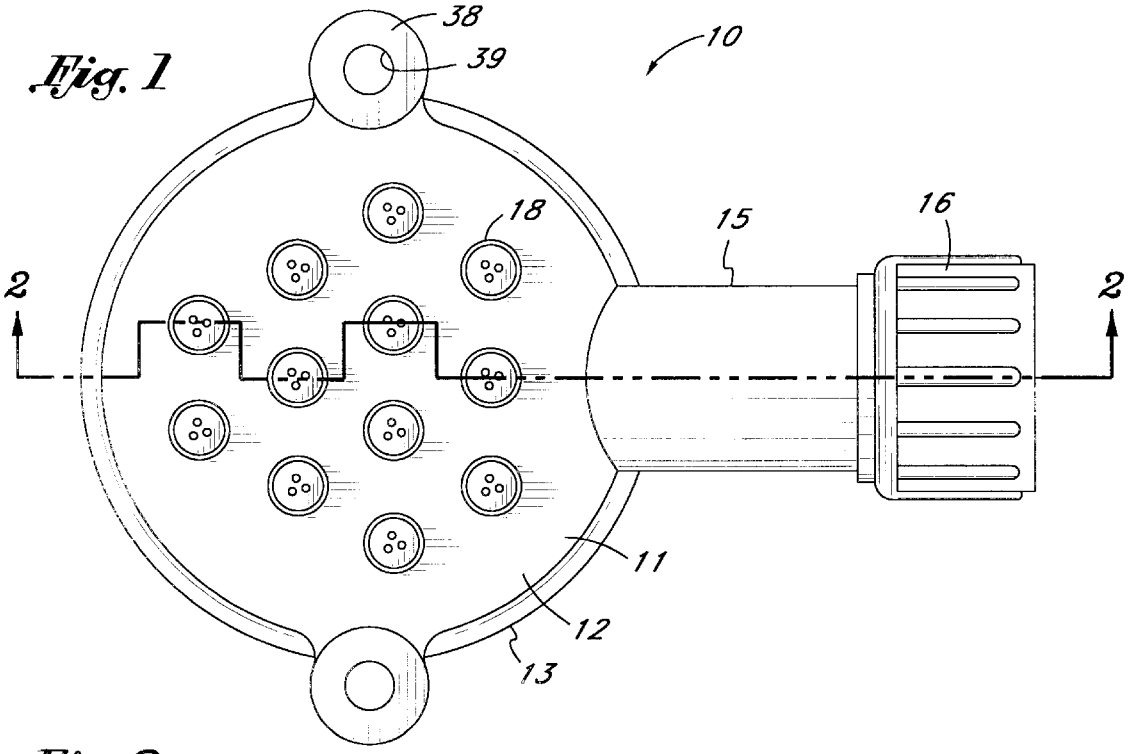
FIG. 1 is a plan view of the lawn and garden sprinkler of the present invention.

A lawn and garden sprinkler is shown in FIG. 1 in plan view and indicated generally by reference character 10. Lawn and garden sprinkler 10 has a manifold 11 which has a top or upper wall 12, a side wall 13 and a bottom 14. The manifold is supplied water through an inlet 15 which has a conventional turnable knurled female connector nut 16 which may be attached to a garden hose and this contains a combination filter screen/hose washer 17 as shown in FIG. 2 which is also conventional.

Figure 2:
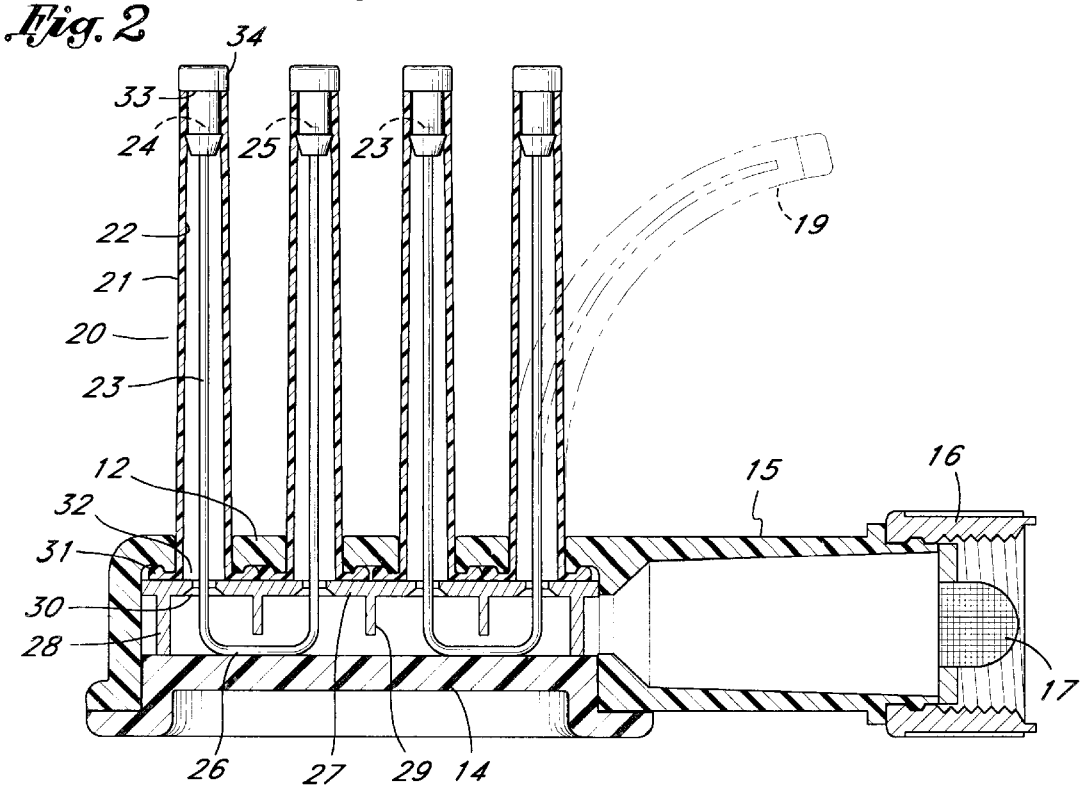
FIG. 2 is a cross-sectional view taken along line 2—2 of FIG. 1.

Sprinkler 10 has 12 bendable tube assemblies indicated generally by reference character 18 which are shown in a vertical position in FIGS. 1 and 2 but which may be bent to any desired position as shown in phantom view and indicated by reference character 19 in FIG. 2. Each bendable tube assembly 18 has a flexible tube 20 with an outer surface 21 and an inner conduit 22. A ductile wire 23 is formed in a U-shape and has a first end 24, a second end 25 and a base 26. In this way, the bendable tubes may be bent and ductile wire 23 does not twist axially in the flexible tube 20. In a sense, the ductile wire 23 is anchored by virtue of the straight portion of one of its legs. Thus, one leg of the "U-shaped" ductile wire 23 supports the other leg so that it cannot twist axially.

Figure 7:
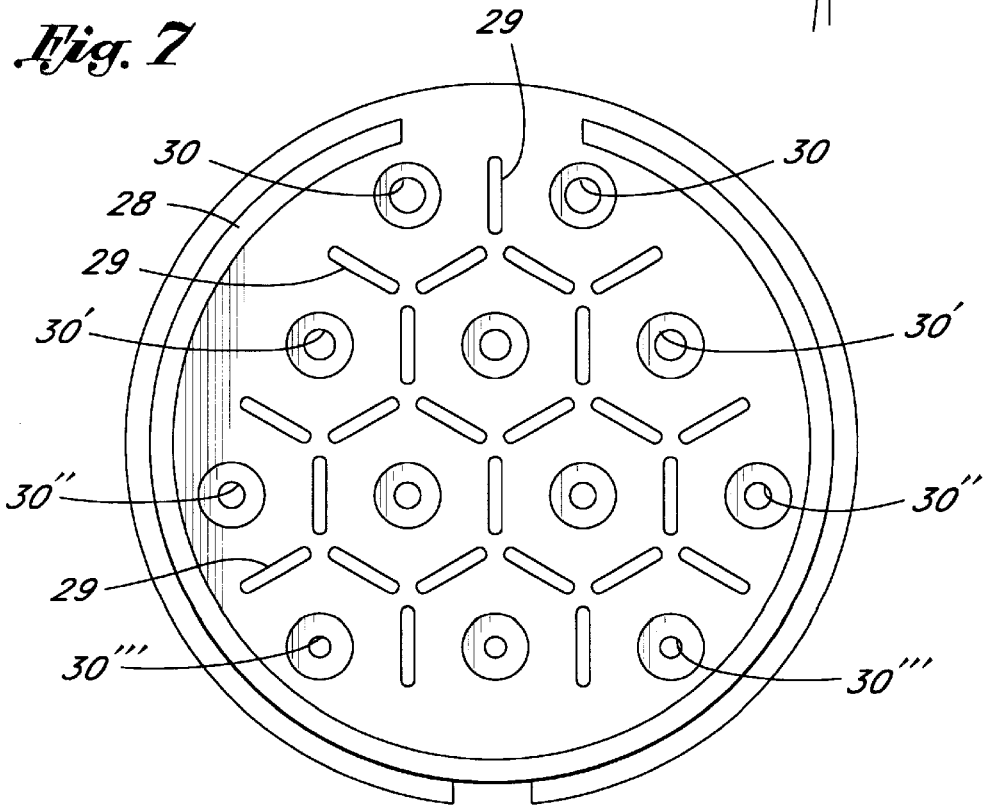
FIG. 7 is a plan view of the restrictor plate of the lawn and garden sprinkler of FIG. 1.

It can also be seen in FIG. 2 that a restrictor plate 27 is captured between the manifold bottom 14 and manifold upper wall 12. Restrictor plate 27 has an outer peripheral wall 28 and a plurality of inner walls 29. These are shown best in FIG. 7. These inner walls help to position the ductile wires 23 and prevent them from shifting upwardly and unduly restricting the nozzle orifices 35. As also shown in FIG. 7, there are four sets of sizes of openings which cause more water to flow to some bendable tubes than to others. Thus, there are two of the largest openings 30, three of the large openings 30', four of the small openings 30" and three of the smallest openings 30'''. Although four sizes of openings are shown, it would, of course, be possible to have each opening slightly larger than its adjacent opening so that no two openings would be the same size.

Alternate means may be used to cause different water flow rates through different tubes than these. For instance, different size bendable tubes could be used where more water would flow through larger tubes than smaller ones. Alternatively, different sizes of flow restrictor could be inserted near the entrance end 32. Another alternate would be the use of different sized nozzles.

Restrictor plate 27 also serves to capture the bottom flange 31 of each of the flexible tubes 20 at the entrance ends 32, to provide a means of sealing the water pressure where the flexible tubes are assembled into the manifold 11. Thus, the sprinkler may be assembled with a minimum number of parts and a minimum amount of labor.

Figure 6:
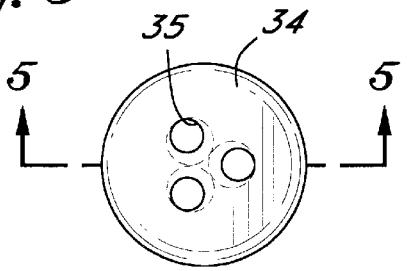
FIG. 6 is a top view of the nozzle of FIG. 5.

At the exit end 33 of each flexible tube 20, there is inserted a nozzle 34. Nozzle 34 preferably has one or more orifices or passageways 35 as shown in FIG. 6. It has been found that three passageways 35 provide appropriate coverage of water downstream. As also shown best in FIG. 5, the individual passageways are formed so that they diverge and each shoots a stream of water at an angle "a" from the central axis 36 of the nozzle. It has been found that an angle of about 5° is appropriate so that each nozzle has somewhat divergent streams of water exiting therefrom to help reduce the possibility of pooling of the water and produce a more even dispersion.

Figure 5:
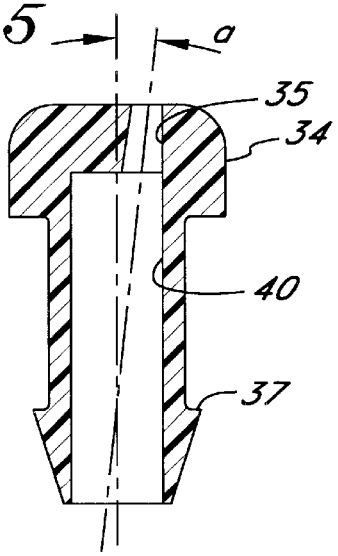
FIG. 5 is a cross-sectional view of a nozzle of the lawn and garden sprinkler of FIG. 1 taken along line 5—5 of FIG. 6.

It is anticipated that the nozzles such as nozzle 34 of FIG. 5 would have a barbed end 37 so that it may be inserted at the exit end of each flexible tube 20 and stay in place.

Figure 3:
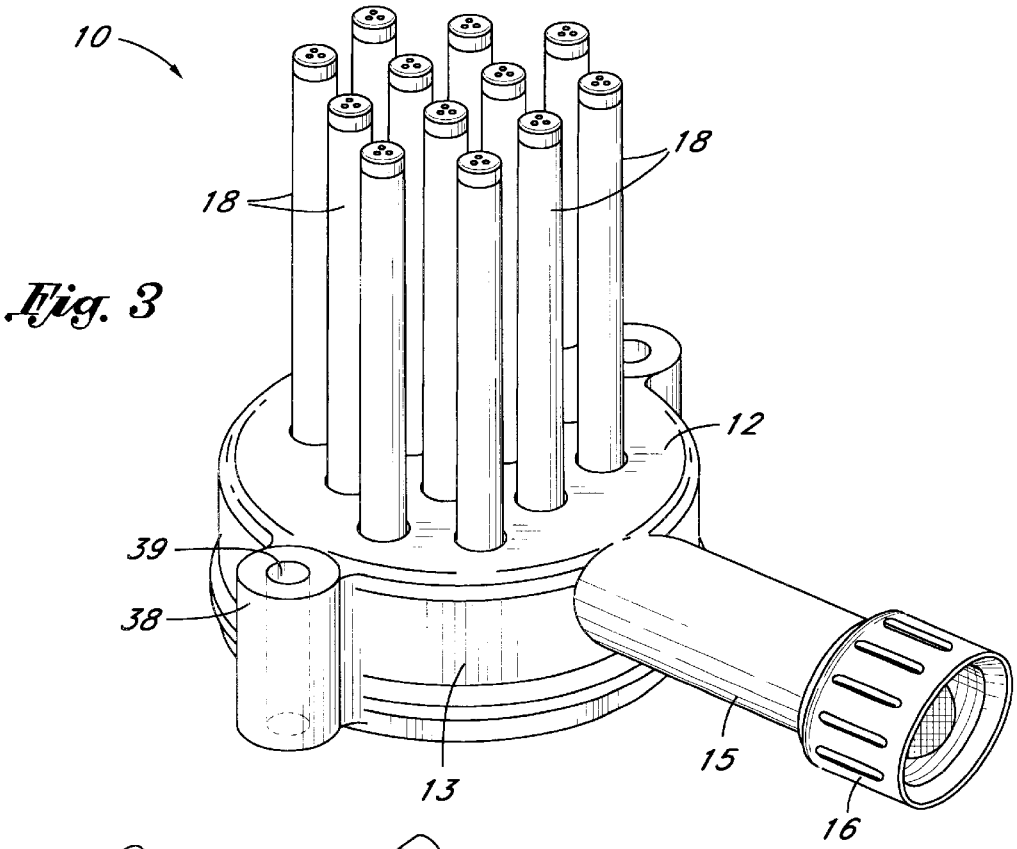
FIG. 3 is a perspective view of the sprinkler of FIG. 1.
Figure 4:
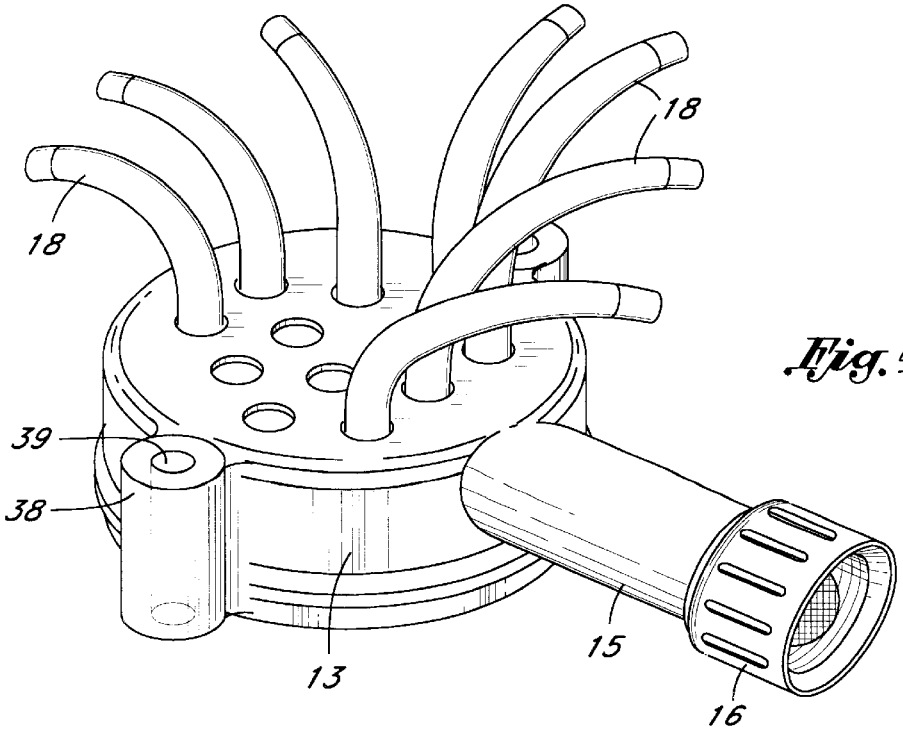
FIG. 4 is a perspective view of the sprinkler of FIG. 1. showing tubes bent in a user desired direction.

As shown best in FIG. 3, the sprinkler would typically be supplied with vertical tube assemblies 18, but these tubes may be bent as shown in FIG. 4 by the user into any desired curve and of course may be adjusted by further bending almost an indefinite number of times in any direction. The ductile wire 23 should be formed of a material that will permit multiple bending and also will not corrode, such as soft temper ductile stainless steel wire. Although the bendable tubes of FIGS. 1 through 4 are shown exiting from the top or upper wall 12 of the manifold, they could, of course, also or alternatively exit from the sidewall 13 or even in a linear array. Sprinkler 10 also preferably has a pair of ears 38 with openings 39 through which a spike or other object may be inserted to hold the sprinkler at a single position on the ground, or affixed to a wall or fence by various means of attachment. In FIG. 4 only some of the tubes have been shown and the others have been eliminated to better illustrate the tubes which are shown.

It has also been found desirable to provide flexible tubes 20 of different colors or with numbering indices so that the tubes which are positioned over the largest openings 30 would be a different color or number from those exiting over large openings 30' and so forth. This reduces the adjustment time for the sprinkler end user. It has been found possible to provide water streams of a distance of from four to twenty feet at 45 psi inlet pressure. That is, the tubes over the smaller openings 30''' would throw water streams from four to ten feet, the intermediate openings 30'' from nine to fifteen feet and so forth. While the bendable tubes have been shown as flexible tubes with a ductile wire inside, it is also contemplated that other types of bendable tubes could be used. For instance, corrugated ductile metal tubes could be used and would need no inner ductile wire. Also, bellows-shaped plastic tubes have been made which may be bent into a predetermined shape. Still further, ductile wire could be molded or extruded in the wall of flexible tubes to make them bendable. Because of the benefit of using pairs of U-shaped wires, it is typical that an even number of bendable tube assemblies 18 would be used. It is preferable that there be at least eight bendable tube assemblies to provide a sufficient variety of water coverage patterns and twelve bendable tube assemblies is preferred. It is also preferable that the ends 24 and 25 of the U-shaped ductile wires 23 be positioned within the inner wall 40 of each nozzle 34 as shown best in FIG. 2. In this way there is a reduced possibility of damage to the flexible tube 20 caused by contact with the wire's sharp ends 24 and 25.

Where the term "stationary position" is used in the claims to define the bendable tubes, it is to be understood that there could be some small amount of movement when the water is turned on. The term "stationary" is intended to distinguish the movement of a flexible tube and it is to be understood that a very small amount of movement will occur with varying water pressure because the innate elasticity of the ductile and bendable tube and the force exerted by the exiting water stream. It is also to be understood that the sprinkler manifold may be attached directly to a riser rather than through inlet 15 shown in FIG. 1.

The result of the design of the present invention is a sprinkler which is economical to manufacture, intuitive to use and adjustable over a wide range of shapes or patterns. It also can be placed under a tree and adjusted so that the streams hit near the drip line of the tree to insure that the water is used in the most efficient and conservative manner.

The present embodiments of this invention are thus to be considered in all respects a illustrative and not restrictive; the scope of the invention being indicated by the appended claims rather than by the foregoing description. All changes which come within the meaning and range of equivalency of the claims are intended to be embraced therein.

I claim:

1. A lawn and garden sprinkler comprising:

a manifold including means for attachment to a source of water under pressure, said manifold having a base, a side wall and an upper wall;

a plurality of bendable tube assemblies extending upwardly from said manifold, each said bendable tube assembly having an entrance end affixed to said upper wall of said manifold, an exit end which includes means for directing a flow of water therefrom, a flexible tube having an inner conduit, a ductile wire in said inner conduit thereof, and an outer surface;

means for maintaining said plurality of bendable tube assemblies in a fixed, bent configuration which remains in about a stationary position when water is flowing therethrough;

wherein at least one pair of said plurality of bendable tube assemblies includes a single ductile wire having a first and a second end with the first end in one of said pair and the second end is in the other of said pair.

2. The lawn and garden sprinkler of claim 1 wherein said means for directing a flow of water therefrom comprises a nozzle member affixed at the end of each of said bendable tube assemblies, said nozzle member having a plurality of passageways each directing water flow at an angle from a central axis.

3. The lawn and garden sprinkler of claim 2 where there are three passageways, each at an angle of about five degrees from a central axis.

4. The lawn and garden sprinkler of claim 2 wherein said nozzle member has an inner wall and one of said first and second ends of said single ductile wire is positioned within said inner wall.

5. A lawn and garden sprinkler comprising:

a manifold having a base, a side wall and an upper wall, said manifold including a water inlet;

a plurality of bendable tubes extending upwardly from at least one of said walls of said manifold, each of said bendable tubes having a flexible wall surface surrounding an interior water conduit and a ductile wire within each of said flexible walls within the water passageway and each of said bendable tubes having an upper terminus with a nozzle therein; and a water flow restrictor held within said manifold, said water flow restrictor having a plurality of orifices below said bendable tubes.

6. The lawn and garden sprinkler of claim 5 wherein said water flow restrictor is a water flow restrictor plate having an orifice below each of said bendable tubes.

7. The lawn and garden sprinkler of claim 6 wherein said restrictor plate has orifices of at least two different sizes so that more water will flow out of some tubes than other tubes.

8. A lawn and garden sprinkler comprising:

a manifold having a base, a side wall including a side wall inner surface and a top, said top having a plurality of openings therethrough and said manifold having a water input conduit therethrough having an exit port in said manifold;

a plurality of bendable tubes extending upwardly through said plurality of openings, each of said bendable tubes having a water passageway therealong and a water nozzle at a terminus thereof and said bendable tubes being capable of retaining a fixed position when water is fed therethrough; and a water flow restrictor plate positioned within said manifold, said water flow restrictor plate having an outer peripheral surface which fits closely within said side wall inner surface of said manifold, said water flow restrictor plate having an opening below each of said plurality of openings in said top of said manifold, said water flow restrictor plate having an upper surface and a lower surface and said exit port of said water input conduit being positioned below the lower surface of said water flow restrictor plate so that water must pass through said water flow restrictor plate to pass only into said bendable tubes.

9. The lawn and garden sprinkler of claim 8 wherein said water flow restrictor plate has openings of different sizes so that more water will flow through some bendable tubes than others.

10. The lawn and garden sprinkler of claim 9 wherein said water flow restrictor plate has openings of four different sizes.

11. The lawn and garden sprinkler of claim 10 wherein each of said bendable tubes is fabricated from a flexible tube having a ductile wire therein.

12. The lawn and garden sprinkler of claim 9 wherein each ductile wire is formed into a U shape having two termini and a base, the termini being in different flexible tubes and the base being positioned below the lower surface of the water flow restrictor plate.

13. The lawn and garden sprinkler of claim 12 wherein said water flow restrictor plate has a plurality of walls extending downwardly from the lower surface thereof to hold the base of each ductile wire below the lower surface of said restrictor plate.

* * * * *